US005234145A

United States Patent [19]

Padin

[11] Patent Number: 5,234,145

[45] Date of Patent: Aug. 10, 1993

[54] CONCEALABLE PISTOL HOLDER

[76] Inventor: Gilberto Padin, 235 S.W. Le Jeune Rd., Miami, Fla. 33134

[21] Appl. No.: 836,485

[22] Filed: Feb. 18, 1992

[51] Int. Cl.[5] ..... F41C 33/02

[52] U.S. Cl. ..... 224/243; 224/192; 224/911; 224/238

[58] Field of Search ..... 224/192, 193, 198, 243, 224/244, 245, 253, 269, 911, 912, 913, 236, 235, 238, 239, 240; 383/84; 206/317, 3, 38; 150/146, 147, 127; 229/40, 100

[56] References Cited

U.S. PATENT DOCUMENTS

| | | | |
|---|---|---|---|
| 2,487,528 | 11/1949 | Dawson | 206/317 |
| 2,566,569 | 9/1951 | Jensen | 224/239 |
| 3,009,620 | 11/1961 | Leone | 224/911 X |
| 3,437,299 | 10/1967 | Alexander | 224/911 X |
| 5,094,376 | 3/1992 | Baruch | 224/244 X |

FOREIGN PATENT DOCUMENTS

| | | | |
|---|---|---|---|
| 10496 82 | 11/1966 | United Kingdom | 206/3 |

OTHER PUBLICATIONS

Hinde & Dauch, "How to Pack It", pp. 15, 16 copyright 1949.

Soldier of Fortune, "The Gunny Sack", Feb. 1992, Front Cover and p. 72.

Handguns for Sport & Defense, "The Laredoan", Mar. 1992.

*Primary Examiner*—Henry J. Recla
*Assistant Examiner*—Glen T. Barrett
*Attorney, Agent, or Firm*—Jesus Sanchelima

[57] ABSTRACT

A holder for pistols that has the shape of an elongated flat box housing with a clip assembly to permit a user to wear it around his or her waist. The holder is made out of self-standing and substantially flexible one sheet of leather and it has pistol support tongues that are extension of one of the sides inwardly bent and rigidly secured to the inner surface of the rear wall. Support loops are rigidly mounted to the inner surface of front wall and they cooperatively receive the pistol's magazines. A front wall is hingedly mounted so that a user can readily exposed the pistol by pushing rearwardly.

3 Claims, 2 Drawing Sheets

CONCEALABLE PISTOL HOLDER

BACKGROUND OF THE INVENTION

1. Field of the Invention.

The present invention relates to holders for pistols, and more particularly, to such holders that can be comfortably carried by a user concealing the weapon contained therein.

2. Description of the Related Art.

Several holsters have been designed in the past. Some of them to conceal weapons. Their structure, however, is quite revealing even when covered by a user's garment. The prior art lacks a holder that can be readily manufactured from one piece of a flexible sheet. None of such designs in the prior art have combined the features and characteristics of the present invention as claimed herein.

SUMMARY OF THE INVENTION

It is one of the main objects of the present invention to provide a holder for pistols that can be worn by a user concealing the pistol while at the same time making the pistol readily available.

It is another object of this invention to provide a holder that includes space to store a pistol magazine.

It is another object of this invention to provide such a holder that is aesthetically appealing and comfortable to wear.

It is still another object of the present invention to provide such a holder that is made of one piece of a substantially flexible material.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
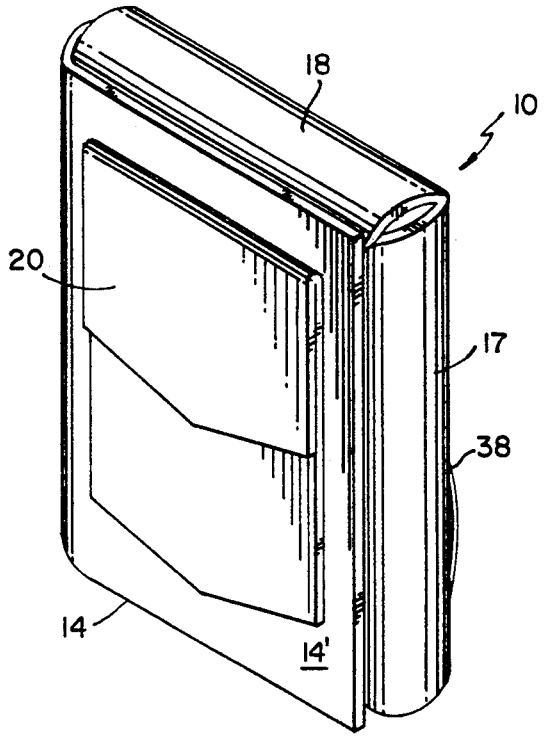
FIG. 1 represents an isometric view of the pistol holder.
Figure 2:
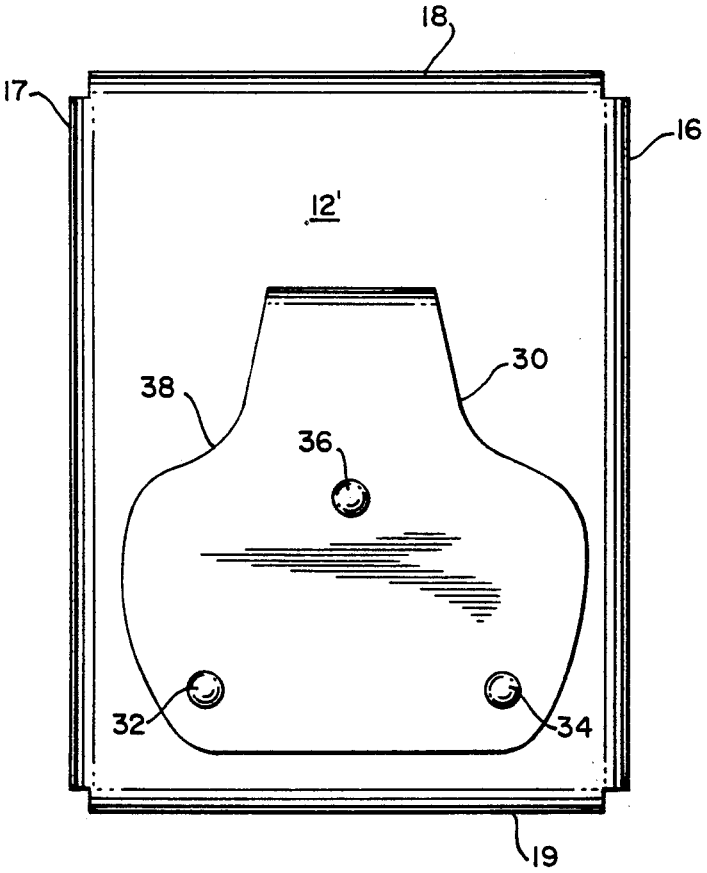
FIG. 2 is a back elevational view of the holder.
Figure 3:
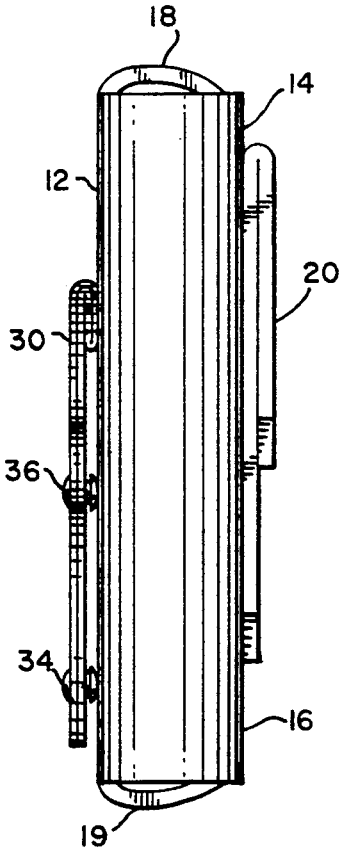
FIG. 3 is an elevational side view of the holder.

Referring now to FIGS. 1, 2 and 3, where the present invention is generally referred to with numeral 10, it can be seen that it has a housing having substantially the shape of a box including the following walls: rear 12, front 14, sides 16 and 17, top 18 and bottom 19. Ornamental design member 20 is used to cover the Velcro stitching affixing the hook and loop fasteners 50 and 52 to the inner surface of the front panel 14. Velcro is a trademark for hook and loop fasteners. Outer surfaces will be designated with same numeral as their corresponding wall with a prime symbol whereas the internal surface will have two prime symbols, i.e., 14' for the outer surface and 14'' for the internal surface of wall 14.

Clip assembly 30 is a conventional device used to secure holsters and holders to users' pants, belts, etc., and it is rigidly mounted to rear surface 12', as best seen in FIG. 2. Clip assembly 30 can also be of the type that allow the belt of the user through. However, it has been found that the type shown here, as the preferred embodiment, permits a user to slide holder 10 around the waist without being obstructed by the loops. Rivet members 32, 34 and 36 include a headed termination mounted to flap 38. Flap 38 is removably inserted inside the waist line of a user's pants. When a user pulls pistol P, rivet members 32, 34 and 36 get caught with the user's pants preventing holder 10 from leaving its place.

Figure 4:
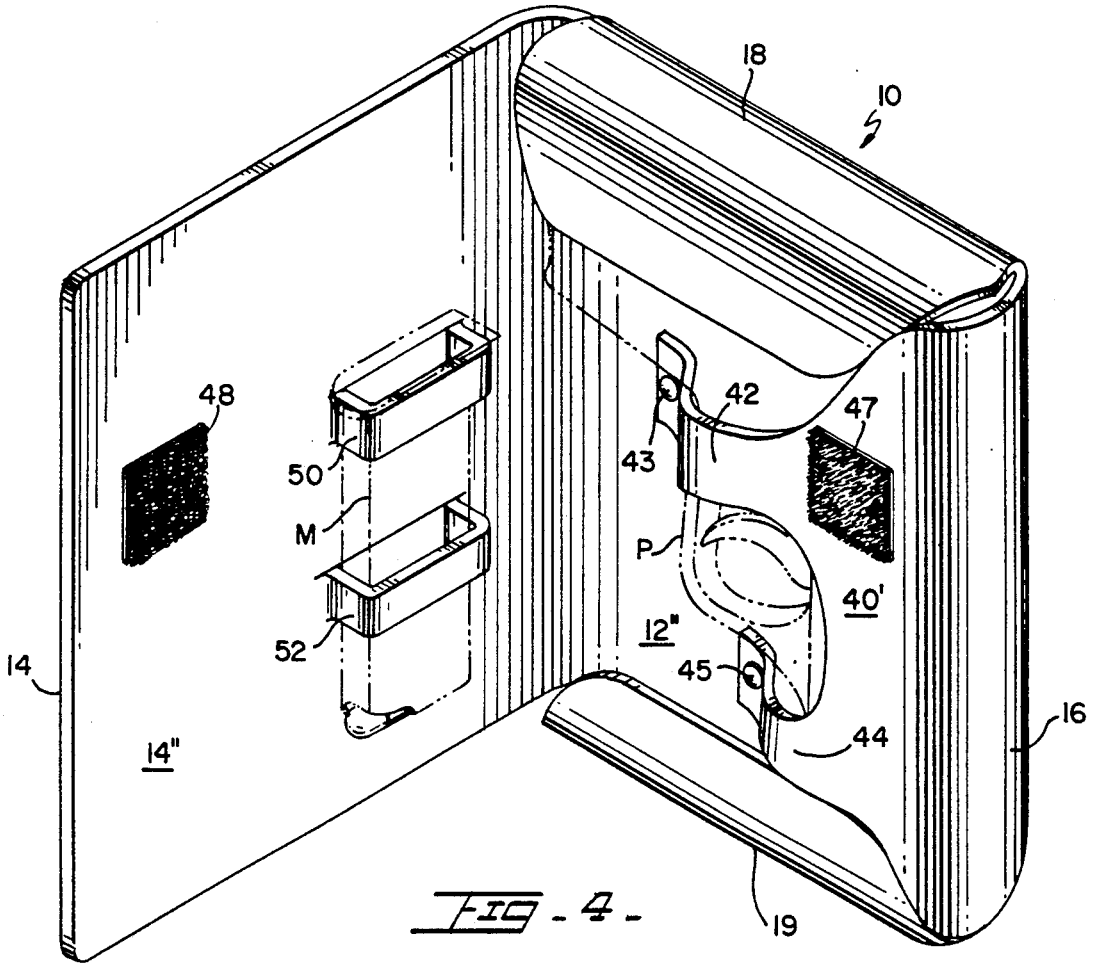
FIG. 4 shows an isometric view of the pistol holder opened showing the pistol in phantom.
Figure 5:
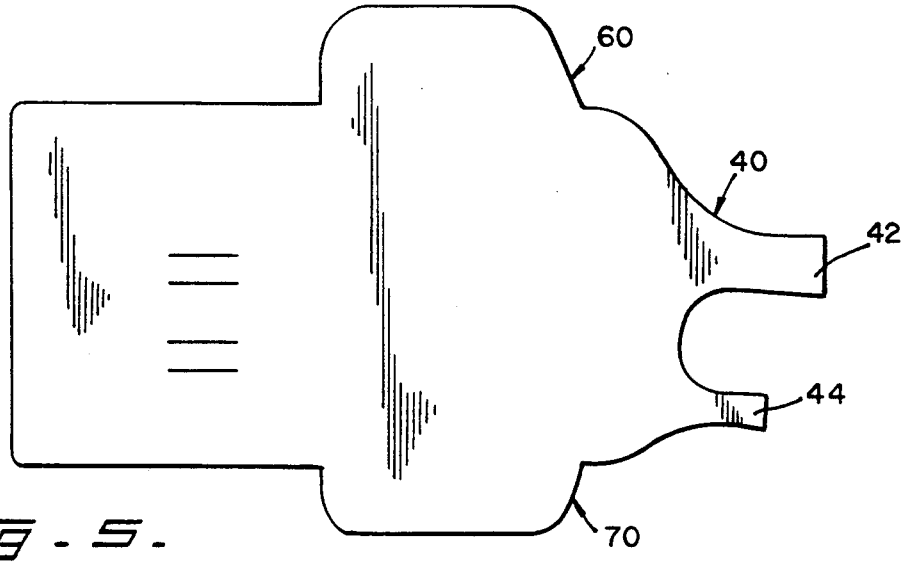
FIG. 5 shows the holder shown in the previous figures flattened out.

Referring now to FIGS. 4 and 5, it can be seen that pistol P is shown in phantom where it is carried by holder 10. End flap 40 has a contour that includes large and small tongues 42 and 44, respectively. End flap 40 is bent inwardly thereby defining side wall 16. The end of large and small tongues 42 and 44 are rigidly affixed to wear wall 12 through rivet members 43 and 45, preferably. The dimensions of large and small tongues 42 and 44 are such that they cooperatively receive the trigger and barrel portions of pistol P. Holders 10 are manufactured for different shapes and calibers of pistols. Therefore, the dimensions of large and small tongues 42 and 44 vary accordingly. Velcro pad 47 is mounted to the outer surface 40' of end flap 40 and a cooperating Velcro pad 48 of the opposite type is mounted to internal surface 14'' of front wall 14 so that the latter is kept adjacent to end flap 40 and at a spaced apart relationship with respect to wall 12 thereby defining a cooperating space in between to house pistol P.

Loop members 50 and 52 are preferably integrally built from wall 14 and they are aligned so that they cooperatively receive magazine M of pistol P. Loop members 50 and 52 are positioned so that magazine M does not interfere with pistol P when wall 14 is closed.

Upper and lower flap members 60 and 70 are also bent inwardly, as shown in FIGS. 4 and 5, to define upper and lower walls 18 and 19, respectively. They extend a sufficient distance to ensure that pistol P is covered when members 60 and 70 are bent inwardly. Side wall 16 becomes more flexible with the opening and closing of front wall 14.

The material used in the preferred embodiment is leather having sufficient thickness that makes it a, self-standing material and still substantially flexible. Side wall 16 becomes more flexible with the opening and closing of front wall 14. The flexibility of flap 18 can be increased through the application of suitable oil products for this purpose. Optionally, side wall 17 receives some oil to make the hinge function easier. Also, vinyl and other plastic materials can be used with these characteristics. The flexibility of vinyl members is controlled through its thickness.

A user can readily withdraw pistol P with one hand by separating wall 14 by pushing it rearwardly and outwardly. Pistol P is immediately exposed so that it can be withdrawn by pulling it substantially upwardly. The time spent withdrawing a weapon is very important with these concealable pistol holders.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A holder for a pistol to be worn by a user comprising: a housing having an interior with substantially rectangular rear, front, bottom and top walls and further including first and second substantially rectangular side walls, and all of said walls having inner and outer surfaces, thereby defining a space therein and said front wall being hingedly mounted to one of said side walls so that a user can readily open said housing and have access to the interior of said housing and said rear wall further including first support means for holding said pistol in place wherein said housing is made out of one self-standing substantially flexible sheet and said sheet has said front, first side wall, rear and second side walls contiguously formed wherein said second side wall is contiguously formed as an extension of said rear wall and said top and bottom walls are contiguously formed to said rear wall, wherein said first support means includes at least one tongue from said second side wall and forming a loop by being inwardly bent and rigidly mounted to said rear wall thereby cooperatively receiving said pistol.

2. The holder set forth in claim 1 wherein said first support means includes short and long tongues forming respective loops by being inwardly bent and rigidly mounted to said rear wall thereby cooperatively receiving said pistol.

3. The holder set forth in claim 2 wherein said pistol includes a magazine and further comprising second support means adapted to receive said magazine mounted to the inner surface of said front wall.

* * * * *